United States Patent [19]

Hodge

[11] Patent Number: 4,664,557

[45] Date of Patent: May 12, 1987

[54] METHOD AND APPARATUS FOR CONSTRUCTING AN UNDERWATER FILL

[75] Inventor: William E. Hodge, West Vancouver, Canada

[73] Assignee: Phoenix Engineering Ltd., Vancouver, Canada

[21] Appl. No.: 713,241

[22] Filed: Mar. 18, 1985

Related U.S. Application Data

[63] Continuation-in-part of Ser. No. 589,941, Mar. 15, 1984, abandoned.

[51] Int. Cl.[4] ..... E02D 27/52

[52] U.S. Cl. ..... 405/223; 405/217; 405/195

[58] Field of Search ..... 405/50–52, 405/117, 217, 222, 223, 40, 207, 208, 203, 204

[56] References Cited

U.S. PATENT DOCUMENTS

| | | | |
|---|---|---|---|
| 218,875 | 8/1879 | Green | 166/52 |
| 674,192 | 5/1901 | Bolling | 405/43 X |
| 804,092 | 11/1905 | Brants | 405/43 |
| 2,895,301 | 7/1959 | Casagrande et al. | 405/208 |
| 3,274,782 | 9/1966 | Landau | 405/50 |
| 3,427,810 | 2/1969 | Petersen | 405/43 |
| 3,434,540 | 3/1969 | Stein | 405/117 X |
| 3,731,492 | 5/1973 | Ageev et al. | 405/117 |
| 3,902,323 | 9/1975 | Watanabe | 405/43 |
| 4,103,502 | 8/1978 | Cashman | 405/217 |
| 4,397,587 | 8/1983 | Velde et al. | 405/222 |

FOREIGN PATENT DOCUMENTS

| | | | |
|---|---|---|---|
| 0052420 | 4/1980 | Japan | 405/217 |
| 7205562 | 10/1973 | Netherlands . | |
| 8267 | of 1914 | United Kingdom | 405/51 |
| 1264790 | 2/1972 | United Kingdom | 405/50 |
| 1433547 | 4/1976 | United Kingdom | 405/207 |
| 2058181 | 4/1981 | United Kingdom | 405/217 |
| 2079826 | 1/1982 | United Kingdom | 405/207 |

OTHER PUBLICATIONS

"Boundary Conditions for the use of Dredging Equipment" by J. De Honing; May 1968.

*Primary Examiner*—Dennis L. Taylor

*Attorney, Agent, or Firm*—Klarquist, Sparkman, Campbell, Leigh & Whinston

[57] ABSTRACT

A method of constructing an underwater fill in a manner which enables the formation of a dense fill pile having steep side slopes and having an improved capability to resist erosion. The method comprises withdrawing water from fill deposited at an underwater construction site as fresh fill is added to the underwater fill pile.

Apparatus for performing the method comprises a perforated conduit, pumping means for pumping water and a closed conduit for water communication between the perforated conduit and the pumping means. Operation of the pumping means withdraws water from underwater fill surrounding the perforated conduit for passage through the conduits and discharge from the pumping means.

17 Claims, 10 Drawing Figures

METHOD AND APPARATUS FOR CONSTRUCTING AN UNDERWATER FILL

RELATED APPLICATION

This application is a continuation-in-part of U.S. application Ser. No. 06/589,941, filed 15 March, 1984, now abandoned.

FIELD OF THE INVENTION

This application pertains to a method of constructing an underwater fill (i.e. so as to form an artificial island, causeway, breakwater, etc.) and to apparatus adapted to carry out the method. More particularly, the application pertains to a method of constructing an underwater fill so as to increase the density of the underwater fill pile, increase the angle of inclination of the pile side slopes and improve the fill's ability to resist erosion. The apparatus is used to withdraw water from the underwater fill pile as fresh fill is added to the pile.

BACKGROUND OF THE INVENTION

Artificial islands, causeways, breakwaters and other civil engineering structures are constructed using well-known underwater fill techniques. Typically, particulate fill material such as sand or sand-silt is excavated at an underwater site termed the "borrow pit" and then dumped at an underwater construction site at which the particular structure is desired. Usually, very large quantities of fill material must be excavated and dumped at the underwater construction site in order to accumulate an adequate base to support whatever structures may be desired above the surface of the water. For example, if it is desired to build a causeway, then sufficient underwater fill must be dumped at the construction site to form an above-water surface upon which a road or railbed of desired width may be constructed. Similarly, if it is desired to build an artificial island, then sufficient fill must be deposited at the underwater construction site to yield an island having an above-water surface area adequate to support whatever buildings or equipment may be required to satisfy the contemplated end use of the island.

Masses of particulate fill dumped at an underwater site tend to form underwater fill piles shaped like truncated cones. It has been found that the side slopes of such piles typically form an angle of about three to five degrees with respect to the horizontal. It is the relatively shallow side slope inclination of the underwater fill pile which necessitates dumping massive quantities of fill material at the underwater construction site in order to accumulate an underwater base which will yield the desired above-water surface area.

Suppose, for example, that it is desired to construct an artificial island in fifteen meters of water such that the island surface is circular, one-hundred meters in diameter and projects two meters above the surface of the water. It can easily be shown that about 1,300,000 cubic meters of fill material would be required to construct the island if its sides slope at about five degrees with respect to the horizontal. Approximately three to four months would be required to construct the island using conventional dredging techniques.

Clearly, the time required to construct an island or other underwater structure could be reduced if the amount of fill material required could be reduced. Reduced construction time is of particular interest with respect to Arctic construction projects since climatic conditions in the Arctic permit construction operations to be carried out for at most three months of the year. The cost of constructing an artificial island (or other underwater fill) could also clearly be reduced by reducing the amount of fill material consumed. Concomitant environmental advantages may also be obtained by reducing the amount of fill material consumed, since the size of the borrow pit could be minimized, along with the surface area of the underwater bed upon which fill material must be deposited to yield the desired structure.

Obviously, the amount of material required to construct an underwater fill may be reduced so as to yield the aforementioned advantages by steepening the angle of inclination of the pile side slopes with respect to the horizontal. For example, if the artificial island discussed in the above example could be constructed with side slopes angled at fifteen degrees with respect to the horizontal, then only about 370,000 cubic meters of fill material would be required. Stated another way, less than one-third as much fill material, requiring only about one-third as much time to excavate and deposit, would be required to construct the island with fifteen degree side slopes as opposed to five degree side slopes. If the island was to be constructed in thirtyfive meters of water (as opposed to fifteen meters of water), then an island with fifteen degree side slopes would consume less than twenty percent as much fill material and construction time as an island having five degree side slopes. Indeed, the amount of fill and time required to construct an island having fifteen degree side slopes in thirty-five meters of water is roughly the same as would be required to construct a conventional island (having five degree side slopes) in only fifteen meters of water.

The difficulty, of course lies in overcoming the natural tendency of particulate fill material to accumulate in piles having three to five degree side slopes when deposited underwater during conventional construction operations. The state of the art is such that it is currently considered impractical to use underwater fill techniques to construct artificial islands in Arctic water deeper than about fifteen meters, since the shallow (i.e. about three to five degree) angle of inclination of the fill pile side slopes necessitates excavation and dumping of more material than can be handled during the short Arctic construction season. Where large working platforms are required in deeper Arctic water (i.e. up to about thirty-five meters), current practice is to utilize a costly structure (about $150,000,000) resting on a sand filled berm about ten meters high formed with conventional underwater fill techniques.

The present invention provides a method and apparatus for constructing an underwater fill which overcomes the foregoing disadvantages, facilitating construction of underwater fills having side slopes inclined at angles significantly greater than five degrees with respect to the horizontal, thereby greatly reducing the amount of fill material and time required.

SUMMARY OF THE INVENTION

The inventor believes that the angle of inclination with respect to the horizontal at which particulate fill may accumulate during construction of a conventional underwater fill pile is limited by forces generated during construction of the fill. Such forces are believed to originate in the potential energy of the fill material dumped onto the pile, to develop within the pile and to act essentially radially outwardly against the pile side slopes as the pile is formed. In particular, the inventor believes that, during construction, fresh fill material dumped onto the accumulating underwater fill pile tends to compress "pore water" trapped in the interstices between adjacent particles of fill within the pile. Since water is virtually incompressible, the pore water tends to flow radially outwardly from the centre of the accumulating pile, to escape therefrom at the side slope interface between the pile and the surrounding water. It is believed that the escaping pore water subjects the pile side slopes to forces which tend to knock the side slopes down (or at least tend to flatten the side slopes). The inventor believes that the side slope inclination of the fill pile may be increased by countering the aforementioned forces. To that end, the inventor proposes that, during construction of the underwater fill, water be withdrawn from the pile in controlled fashion and at a rate approximately equal to the rate at which pore water would otherwise be forced out of the pile by fresh fill dumped onto the accumulating fill pile. It is believed that this will minimize the afore-mentioned forces and thus allow the underwater fill pile to accumulate with side slopes much steeper than those conventionally obtained.

Further benefits are believed to be attainable if the water withdrawal operation is effected such that water is drawn into the accumulating fill pile at the interface between the developing side slopes of the pile and the surrounding water. That is, although it is desirable to minimize the flow of water out from the sides of the pile, it is more desirable to stop the outward flow of water altogether and even more desirable to reverse the flow so that water flows into the sides of the accumulating fill pile, thereby supporting the pile side slopes as they are formed and consequently enabling the formation of a steeper, more dense pile. In particular, it is believed that the density of the underwater fill may be significantly increased by drawing water thereinto as aforesaid. Increased density is desirable in underwater fill construction since any post-construction shaking of a loosely formed underwater fill may cause settling or even a catastrophic failure (ie. collapse) of the fill. The accumulating pile also has an improved capability to resist erosion at the regions from which water is withdrawn.

The foregoing theoretical discussion is not to be taken as limiting the invention—it is presented only to assist those skilled in the art in understanding the invention. Because the underlying theories are not well settled, the inventor has developed several statements of characterization for the invention which differ only in the way they express the underlying theory. For example, the invention may be characterized as being directed to a method of relieving water pressure within an underwater fill during construction of the fill, comprising withdrawing water from the underwater fill as fresh fill is added thereto, such that the work done on water withdrawn from the underwater fill is approximately equal to the energy introduced into the underwater fill by the combined action of fill material dumped onto the pile and water set in motion by the material as it settles onto the pile. The invention may alternately be characterized as being directed to a method of relieving water pressure within an underwater fill during construction of the fill, comprising withdrawing water from the underwater fill as fresh fill is added thereto, such that water flow out from the pile side slopes is minimized, stopped or reversed. Alternatively, the invention may be characterized as being directed to a method of increasing the side slope inclination of an underwater fill pile, comprising withdrawing water from the pile as fresh fill is added thereto. As a further alternative, the invention may be characterized as being directed to a method of increasing the packing density of particulate fill deposited in an underwater pile, comprising withdrawing water from the pile as fresh fill is added thereto.

In accordance with the preferred embodiment of the invention, apparatus adapted to carry out the aforementioned methods comprises a perforated conduit, a pumping means for pumping water, and a closed conduit for water communication between the perforated conduit and the pumping means. Operation of the pumping means causes water to be withdrawn from underwater fill surrounding the perforated conduit. The withdrawn water is passed through the perforated conduit and through the closed conduit for ultimate discharge from the pumping means.

Advantageously, a moveable sealing means is provided for sealing a selected portion of the perforated conduit to prevent water communication through the selected portion. The perforated conduit is perforated over at least a portion of its length and the sealing means is preferably moveable with respect to the perforated portion so as to permit pore water communication through a selected portion of the perforated portion. The perforations in the perforated conduit are selectably sized to prevent substantial passage of fill particles into the perforated conduit.

DETAILED DESCRIPTION OF A PREFERRED EMBODIMENT OF THE INVENTION

Figure 1:
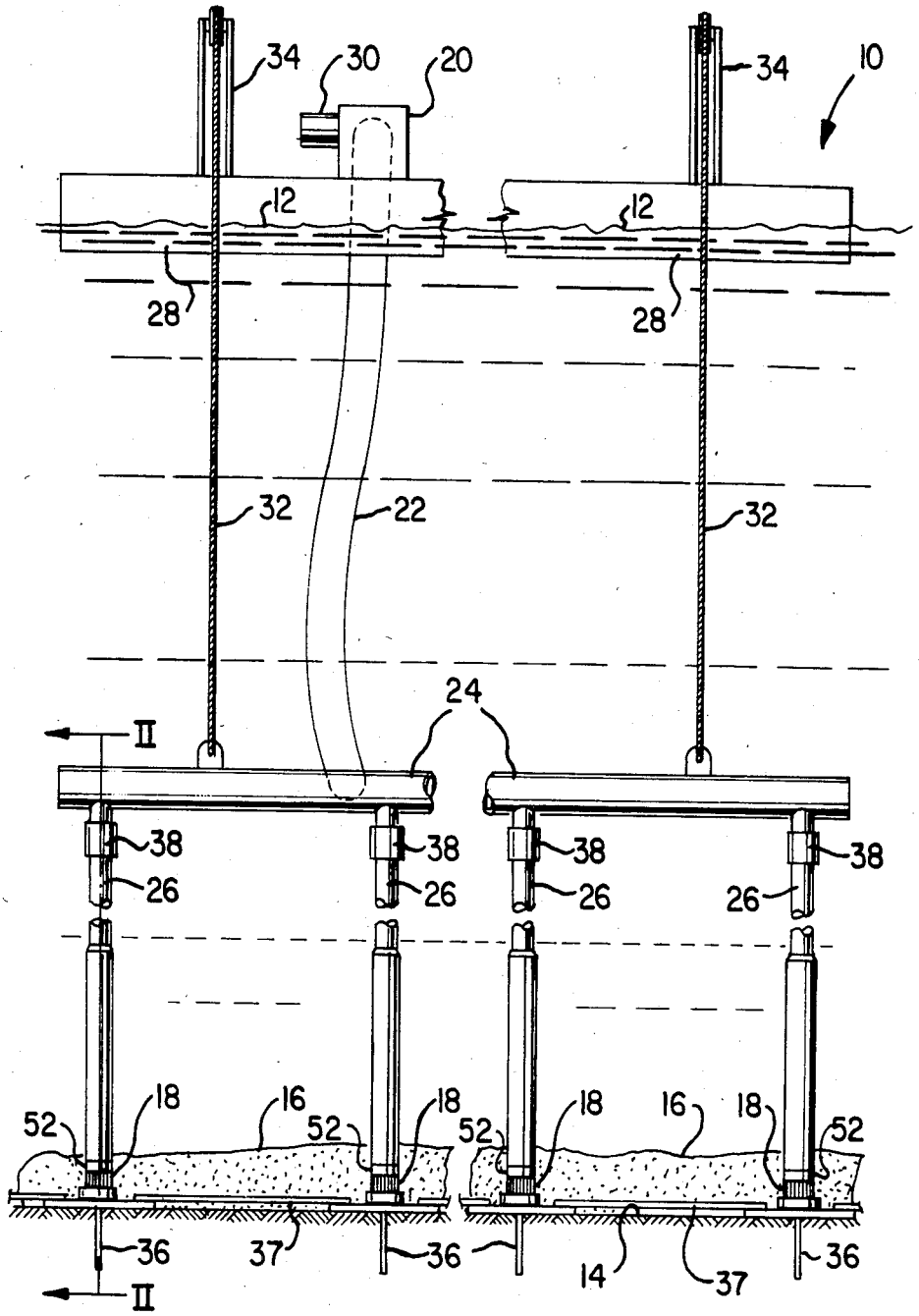
FIG. 1 is a fragmented plan view of an apparatus for constructing an underwater fill in accordance with the invention.

FIG. 1 illustrates apparatus 10 for withdrawing water from an underwater fill during construction of the fill. Reference numeral 12 indicates the surface of the water beneath which the construction operation is carried out. Reference numeral 14 indicates the seabed upon which particulate fill such as sand 16 is deposited as hereinafter described to construct the underwater fill.

Apparatus 10 includes a plurality of perforated conduits 18 arranged in spaced, substantially parallel configuration, a pumping means such as pump 20 and a normally submerged closed conduit comprising conduit portions 22, 24 and 26 which facilitate water communication between perforated conduits 18 and pump 20. As hereinafter explained in greater detail, pump 20 (which may be mounted upon a floating platform 28) draws water through perforated conduits 18 and through conduit portions 22, 24 and 26 for discharge from pump outlet 30. (Preferably, the discharge from pump outlet 30 is directed as far away from the underwater construction site as possible to minimize forces acting upon the accumulating underwater fill pile.) Selected portions of perforated conduits 18 are exposed (as hereinafter explained) to the accumulating underwater fill pile such that operation of pump 20 causes water to be withdrawn from underwater fill surrounding the exposed portions of perforated conduits 18 for passage through conduit portions 22, 24, 26 and discharge from pump outlet 30.

Advantageously, to minimize damage which may be caused by relative motion between floating platform 28 and the seabed 14, conduit portion 22 takes the form of a flexible hose. Such flexibility also simplifies movement of conduit portions 24, 26 and perforated conduits 18 as hereinafter described. Conduit portion 24 may advantageously take the form of a rigid pipe-like "header" having a plurality of conduit portions 26 depending therefrom as illustrated in FIG. 1. Conduit portions 26 may also be of rigid pipe-like construction, capable of telescoping over perforated conduits 18 as hereinafter described. Header 24 may conveniently be about 30 meters long and have depending therefrom about twenty conduit portions 26, each spaced about 1.5 meters apart, with an equal number of perforated conduits 18.

Initially, the portion of the apparatus comprising header 24, conduit portions 26 and perforated conduits 18 is suspended from cables 32 and lowered to seabed 14 from platform 28 by means of winches 34. Cables 32 are left slack once the apparatus reaches the seabed and sufficient fill has accumulated around the base of the apparatus to hold it upright. Cables 32 and winches 34 serve as a "remote manipulator means" for remotely moving conduit portions 26 with respect to perforated conduits 18 as hereinafter described. The weight of the apparatus causes anchoring means in the form of spikes 36 at the base of each of perforated conduits 18 to penetrate seabed 14 and hold the apparatus in position until it becomes covered by sand as hereinafter described. Structural integrity is provided by base plate 40 (FIG. 2) connector plates 37 which interconnect the ends of perforated conduits 18 opposite header 24. Valves 38 provided between each of conduit portions 26 and header 24 may be selectively closed to prevent water communication between header 24 and the associated conduit portion 26 and perforated conduit 18, in the event of a rupture or other occurrence resulting in a significant loss of pressure necessitating isolation of the remainder of the apparatus to prevent degradation of overall performance.

Figure 2:
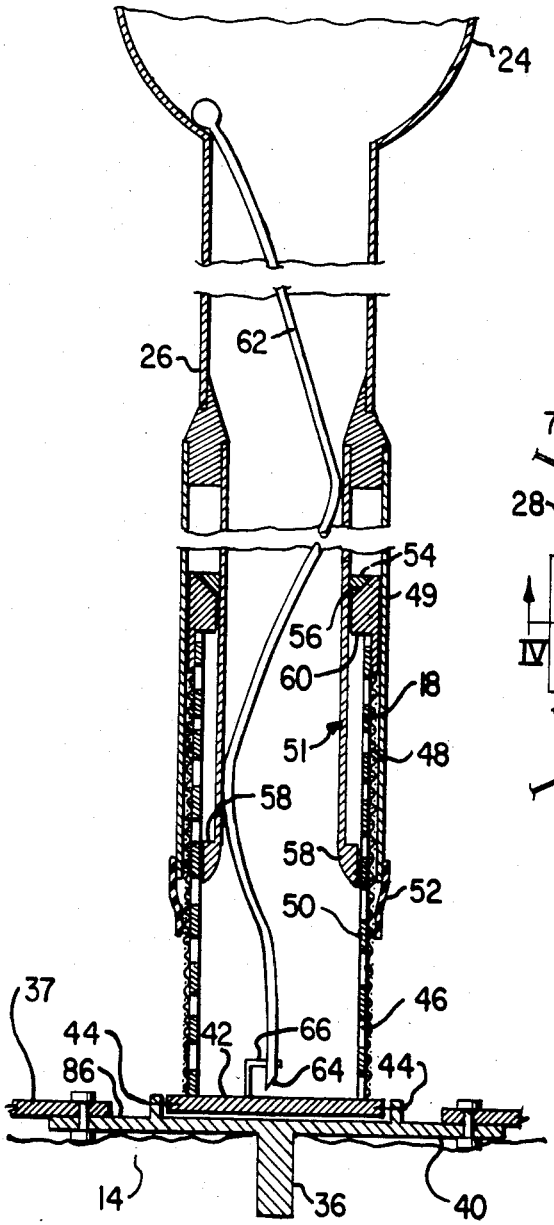
FIG. 2 is a cross sectional illustration of a portion of the apparatus of FIG. 1, taken with respect to lines II—II of FIG. 1.

Further details of the construction and operation of perforated conduits 18, header 24 and conduit portions 26 will now be provided with reference to FIG. 2, which is a cross sectional illustration taken with respect to line II—II of FIG. 1.

As may be seen in FIG. 2, anchoring spike 36 protrudes from a base plate 40 which is releasably attached to the base 42 of perforated conduit 18 by connecting means such as shear pins 44. Base plate 40 limits the depth to which conduit portion 18 may penetrate seabed 14.

Perforated conduit 18 is of generally cylindrical construction and has perforations 46 extending over a substantial portion of its length. Perforations 46 are sized to prevent substantial passage of fill particles into perforated conduit 18. For example, if the underwater fill is to be constructed from typical uniform Delta sand in which about 90% of the sand grains are from 0.1 to 0.4 millimeters in diameter, perforations 46 may be provided by a number 70 or number 100 (A.S.T.M. standard) wire mesh screen 48 (i.e. screen 48 would in such case have apertures about 0.2 millimeters on a side). Preferably, perforated conduit 18 is perforated over about 1.5 meters of its length, the perforated portion commencing at base 42 and extending upwardly therefrom. A perforated tube 50 attached to base 42 and having apertures much larger than those in screen 48 provides internal support for screen 48.

As may be seen in FIG. 2, conduit portion 26 has a sleeve-like portion comprising an outer wall 49 and an inner wall 51, which portion is slidable telescopically over perforated conduit 18. A "sealing means" in the form of tough rubber or elastomeric skirt 52 is fitted around and overlaps the lower end of each conduit portion 26 to prevent water communication through the portion of perforated conduit 18 which is covered by the afore-mentioned sleeve-like portion of conduit portion 26 and skirt 52. The portion of skirt 52 which overlaps the end of conduit portion 26 is drawn tightly against the immediately adjacent outer surface of perforated conduit 18 by the suction created by pump 20 and thus facilitates sealing of a selected portion of perforated conduit 18 so as to prevent water communication through that selected portion.

When the apparatus is initially lowered to seabed 14, perforated conduits 18 are telescoped inside the aforementioned sleeve-like portions of conduit portions 26, leaving no portion of perforated conduits 18 exposed beneath sealing means and thereby precluding water communication through the system. As hereinafter explained in greater detail, fill material deposited at the underwater construction site accumulates around the base of perforated conduits 18, thereby firmly holding the apparatus in position on seabed 14. When perforated conduits 18 are thus anchored on seabed 14, winches 34 may be operated to slowly raise cables 32, header 24 and conduit portions 26, thereby slidably raising skirts 52 with respect to anchored perforated conduits 18 to expose a selected portion of each of perforated conduits 18 to the surrounding fill material. A "wedge means" such as the locking dog assembly comprising dog member 54 and annular shoulder 56 permits raising of conduit portions 26 with respect to perforated conduits 18, but precludes subsequent lowering of conduit portions 26. Conduit portions 26 and skirts 52 may thus be selectively incrementally raised with respect to perforated conduits 18 to expose progressively larger sections of perforated conduit 18 to the surrounding fill as the underwater construction operation progresses.

Eventually, as conduit portions 26 and skirts 52 are further raised with respect to perforated conduits 18, internal shoulder 58 of conduit portion 26 contacts the opposing internal shoulder 60 of perforated conduit 18, thereby preventing further upward movement of conduit portion 26 and skirt 52 with respect to perforated conduit 18. Further operation of winches 34 after shoulders 58, 60 come into contact so as to subject the apparatus to further upward forces, will eventually cause shear pins 44 to shear, thereby freeing the apparatus from base plate 40, which is disposable and remains buried in the underwater fill. Advantageously, conduit portions 26 and perforated conduits 18 may have a slight inverted conical taper (not discernible in the drawings) to ease their withdrawal from the accumulating fill pile. The apparatus may then be raised slowly to the surface as underwater construction operations continue, to serve its purpose of withdrawing water from the accumulating fill pile in the region beneath the interface between the fill pile and the surrounding water and of drawing water into the fill pile at that interface.

A flexible "development conduit" 62 extends from header 24 inside conduit portions 26 to the bottom of perforated conduit 18. The end 64 of development conduit 62 is left open and is anchored to base 42 by means of bracket 66. Development conduit 62 facilitates "development" of fill in the region surrounding perforated conduit 18 as hereinafter described to purge that region of finer particulate matter which might clog perforated conduit 18 and to improve water flow through said region to the interior of perforated conduit 18.

Figure 3:
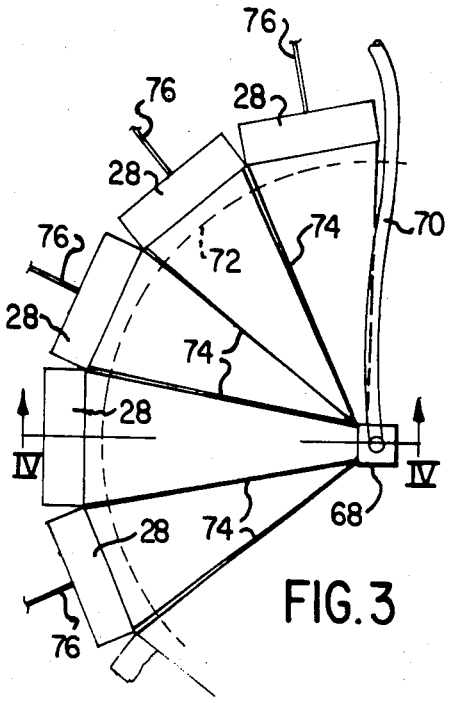
FIG. 3 is a schematic illustration showing how multiple units of the apparatus of FIG. 1 may be deployed to construct an artificial island.

FIG. 3 is a top view which illustrates how multiple units of apparatus like that shown in FIG. 1 may be deployed at a construction site to construct an artificial island. A fixed working platform 68 may be positioned at the desired centre of the island (presuming that the island, when completed, will be of approximately circular shape). Particulate fill material to be deposited at the underwater construction site is supplied, in the form of a slurry, to platform 68 through dredge pipe 70. Multiple units of apparatus like that described above are deployed from a series of floating platforms 28 along the desired shoreline of the finished island (indicated in FIG. 3 by broken line 72). Cables 74, 76 tether floating platforms 28 (from which the apparatus is deployed) to fixed platform 68 and to remote anchors (not shown).

FIGS. 4 through 9 are a series of side sectional illustrations taken with respect to line IV—IV of FIG. 3 which show successive stages of operation of the apparatus which has been described with reference to FIGS. 1 and 2.

Figure 4:
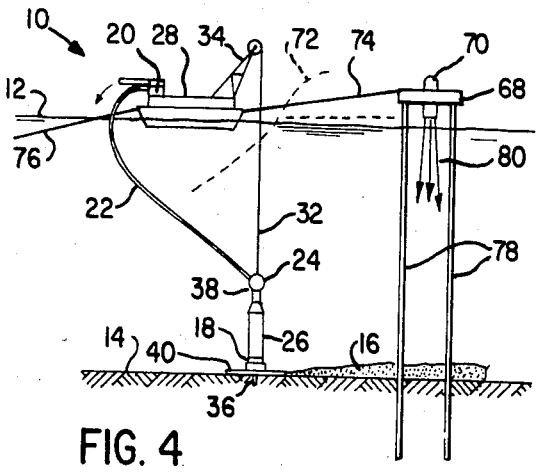
FIGS. 4 through 9 are enhanced side sectional illustrations of a portion of the apparatus of FIGS. 1 and 3, taken with respect to line IV—IV of FIG. 3, and illustrate the operation of the apparatus of FIG. 1 during successive stages of construction of an underwater fill.

FIG. 4 illustrates how working platform 68 may be suspended above the water surface 12 and fixed with respect to seabed 14 by means of legs 78 which extend from the underside of platform 68 into seabed 14. (Alternatively, platform 68 may be a floating, tethered platform.) FIG. 4 also illustrates one of the floating platforms 28 upon which pump 20 and winches 34 are mounted. In FIG. 4, header 24, conduit portion 26 and perforated conduit 18 have just been lowered on cable 32 to seabed 14 such that spike 36 penetrates seabed 14, anchoring the apparatus in position such that perforated conduits 18 are upstanding on seabed 14 and resting on their respective base plates 40. As previously described, the apparatus is initially deployed with perforated conduits 18 telescoped inside conduit portions 26, leaving no portion of perforated conduits 18 exposed beneath skirts 52. Particulate fill material (excavated from the borrow pit) is supplied as a slurry to working platform 68 through dredge pipe 70 and is discharged from platform 68 onto seabed 14 as indicated by arrows 80. The particulate fill material 16 may be seen in FIG. 4 accumulating beneath platform 68 in a pile having shallow (ie. 3°–5°) sloped sides. Since it takes some time to accumulate a sufficient base of fill on seabed 14 before operation of the apparatus can be commenced effectively, the excavation/discharge operation may be ongoing as platforms 28 are positioned and the apparatus deployed therefrom to the position shown in FIG. 4.

Figure 5:
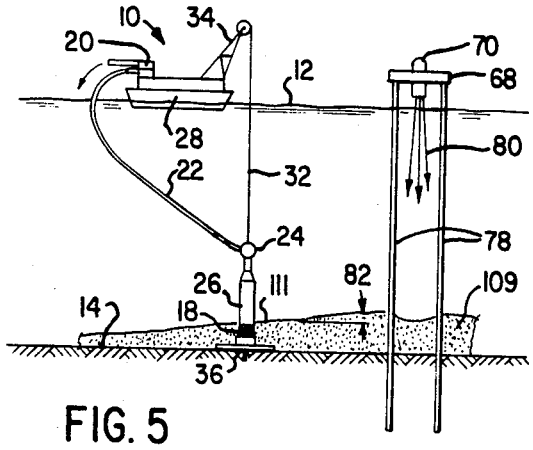

Particulate fill material is dumped onto seabed 14 from dredge pipe 70 until the lower portion of perforated conduit 18 has been covered with fill material to a depth of about 1.5 meters as depicted in FIG. 5. Reference numeral 82 illustrates the conventional shallow (ie. about 3°–5°) angle with respect to seabed 14 at which the particulate fill material accumulates. Once perforated conduit 18 has been buried as aforesaid winch 34 is activated to raise cable 32, header 24 and conduit portion 26 to expose about a 0.5 meter length of perforated conduit 18 to the surrounding fill. The fill region immediately surrounding the exposed portion of perforated conduit 18 is then "developed" with pump 20 and development conduit 62 by periodically reversing the operation of pump 20 to cause water to surge alternately inwards and outwards through the exposed mesh of screen 48 into the surrounding fill material. This action removes from the region of conduit 18, through conduit 62, finer fill material which might clog screen 48 and generally enhances the ability of the surrounding fill region to pass water toward the exposed portion of perforated conduit 18. After the surrounding fill region has been adequately developed (the time required to do so being heavily dependent upon the characteristics of the fill material) pump 20 is operated so as to withdraw water from the fill region surrounding the exposed section of perforated conduit 18, through perforated conduit 18, and conduit portions 26, 24, 22 for discharge from pump 20. Such pumping continues as long as fill is being discharged from dredge pipe 70 onto the accumulating fill pile.

Figure 6:
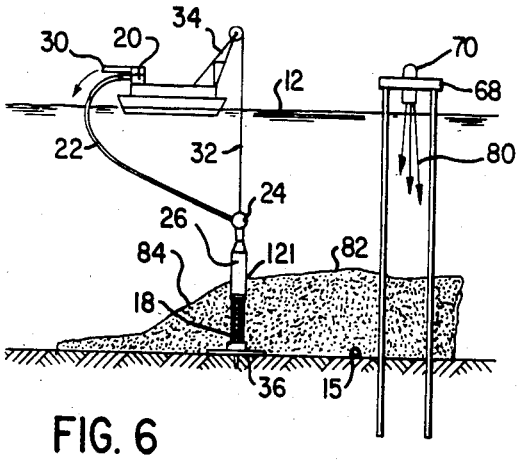

FIG. 6 depicts a later stage at which sufficient fill material has been discharged from dredge pipe 70 to form a fill pile about 3–4 meters deep in the vicinity of perforated conduit 18. In FIG. 6, winch 34 has been further activated to raise cable 32, header 24 and conduit portion 26 so as to gradually increase the portion of perforated conduit 18 which is exposed to the surrounding fill. Pump 20 continues to operate to draw water from the region surrounding the exposed portion of conduit 18, into the interior of conduit 18 and thence through conduit 18, conduit portion 26, header 24 and flexible conduit 22 for discharge from pump outlet 30. Winch 34 is periodically operated as fill material accumulates above the exposed section of perforated conduit 18 to incrementally raise conduit portion 26 and skirt 52 with respect to perforated conduit 18 so as to maintain about one to two meters of fill material above the exposed section of perforated conduit 18. As pump 20 continues to operate, water is withdrawn from the region of the fill pile surrounding the exposed section of conduit 18 and is also drawn into the fill pile at the interface between the pile and the surrounding water, thereby offsetting the forces previously mentioned, facilitating steepening of the pile side slopes (as shown at 84) and the formation of a denser pile having improved erosion resistance at the waterline. As may be seen in FIG. 6, withdrawal of water from the region surrounding the exposed section of perforated conduit 18 results in a transition in the angle of the pile side slope from the relatively shallow angle shown at 82 to the preferred, relatively steep angle shown at 84.

Figure 7:
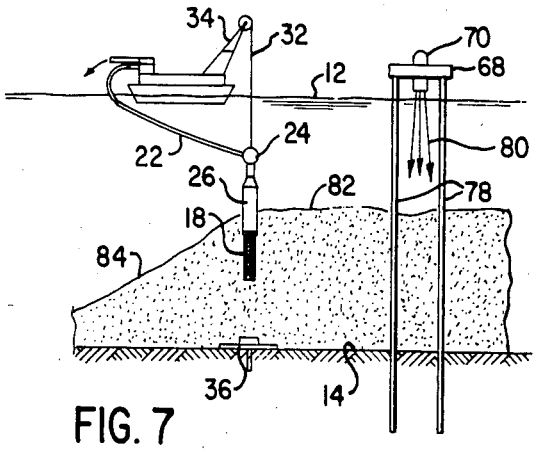

As more fill material is added to the underwater fill pile, winch 34 is further periodically operated to increase the length of perforated conduit 18 which is exposed to the surrounding fill, thus increasing the fill region from which water is withdrawn. Eventually, shoulders 58, 60 (FIG. 2) come into contact with one another and further operation of winch 34 to raise conduit portion 26 with respect to perforated conduit 18 ruptures shear pins 44, thereby freeing perforated conduit 18 from base plate 40. As illustrated in FIG. 7, the freed assembly is drawn slowly upward through the fill pile as more fill is added thereto, always maintaining about one to two meters of fill above the uppermost exposed portion of perforated conduit 18 so that continued operation of pump 20 results in water withdrawal from the accumulating fill pile in the region about one to two meters beneath the region of transition from the relatively shallow slope 82 to the desired steeper slope 84.

Figure 8:
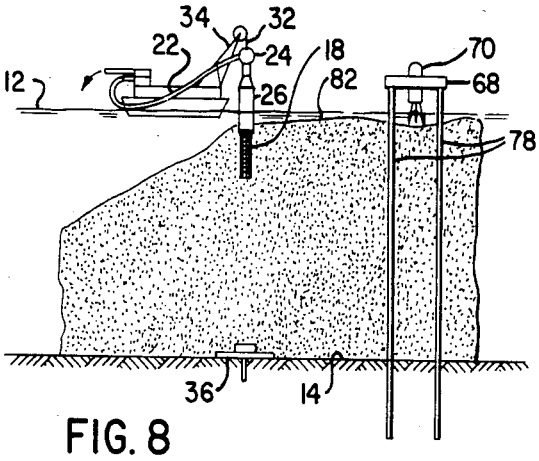
Figure 9:
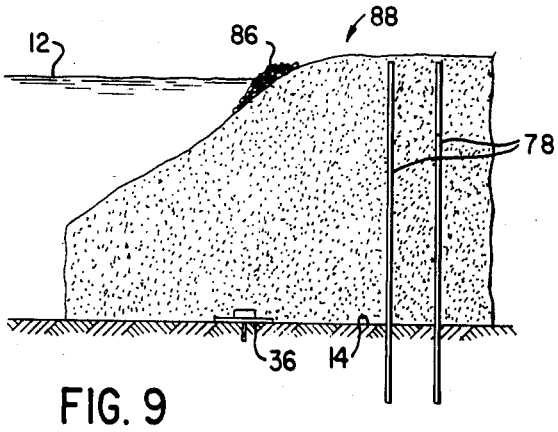

FIG. 8 illustrates a still further advanced stage at which conduit portion 26 has been withdrawn from the fill pile to protrude above the water surface 12 while perforated conduit 18 remains buried beneath the surface of the fill pile and pump 20 continues to operate as the final portion of fill material required to break surface is discharged onto the fill pile through dredge pipe 70. Continued operation of pump 20 at this stage is believed to enhance the resistance of the developing fill shoreline to erosion by wave lapping and scouring until sandbags or other reinforcing means can be positioned. After the fill pile has broken surface to the required height, the apparatus is disassembled and removed and the shoreline protected as shown at 86 in FIG. 9 to leave the finished underwater fill 88.

Figure 10:
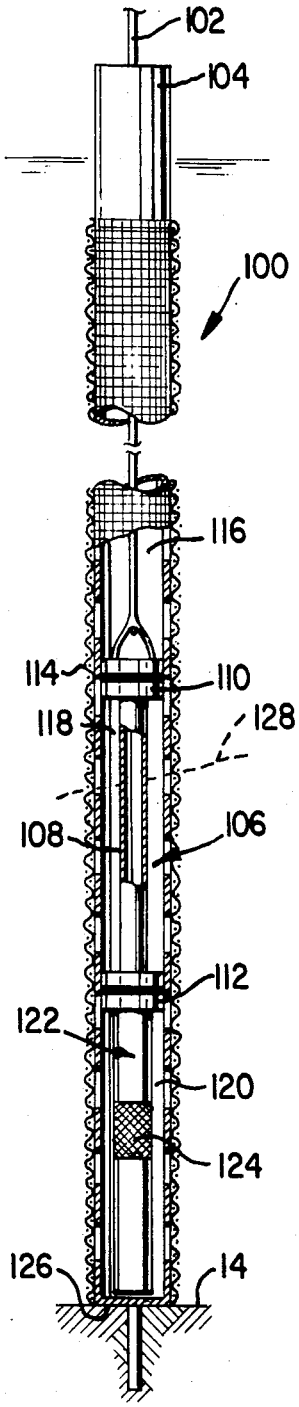
FIG. 10 illustrates an alternative form of the apparatus of FIG. 2.

FIG. 10 illustrates an alternate form of the apparatus shown in FIG. 2. This alternate form eliminates conduit portions 22 and 24 and includes an integral pump, thereby allowing greater flexibility in placement of the apparatus. Cable 102 protrudes through the upper end 104 of apparatus 100 and is connected to a sealing means 106. Sealing means 106 includes an inner conduit 108 with seals 110, 112 fixed at the upper and lower ends thereof.

Seals 110, 112 provide a watertight seal against the inner surface of conduit 114. Conduit 114 is made long enough to extend from the base to the top of the pile, and is perforated over the entire length to be covered by fill material. (Initially some lateral support—not shown—must be provided to hold conduit 114 upright until sufficient fill has accumulated around the base of conduit 114 to support the conduit.) Seals 110, 112 subdivide the inner portion of conduit 114 into upper, central and lower compartments 116, 118 and 120.

Pump 122 may be positioned in lower compartment 120 or in central compartment 118. Pump 122 is operated to draw water through the pump intake 124 and through the perforated portion of conduit 114 surrounding lower compartment 120 into and through inner conduit 108 for discharge into upper compartment 116 from which the water flows outward through the perforated portion of conduit 114 encircling upper compartment 116 and into the surrounding water.

When apparatus 100 is initially placed on seabed 14 inner conduit 108 and seals 110, 112 are positioned so that the base of lower seal 112 is about one meter above the base 126 of conduit 114. Once fill has accumulated on seabed 14 to a depth of about 1.5 meters (illustrated, for example, at 128) pumping may commence. As further fill is deposited on the accumulating pile conduit 108, seals 110, 112 and pump 122 may be incrementally raised on cable 102 to maintain about one to two meters of fill above the uppermost end of lower compartment 120. (As conduit 108 and seals 110, 112 are raised, the volume of lower compartment 120 increases while the volume of upper compartment 116 correspondingly decreases.) Once the fill has been completed cable 102, conduit 108, seals 110, 112 and pump 122 are withdrawn from conduit 114 which remains in place.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. Apparatus for withdrawing water from an underwater fill, comprising:

(a) a plurality of perforated conduits arranged in spaced, substantially parallel configuration;

(b) pumping means for pumping water; and, (c) a closed conduit for water communication between said perforated conduits and said pumping means;

whereby operation of said pumping means withdraws water from underwater fill surrounding said perforated conduits for passage through said perforated conduits and through said closed conduit and discharge from said pumping means.

2. Apparatus as defined in claim 1, further comprising, moveable sealing means for sealing a selected portion of each of said perforated conduits to prevent water communication through said selected portions.

3. Apparatus as defined in claim 1, wherein said perforated conduits are perforated over at least a portion of their respective lengths, and wherein said sealing means are moveable with respect to said perforated portions to permit pore water communication through selected portions of said perforated portions.

4. Apparatus as defined in claim 1, 2 or 3, wherein perforations in said perforated conduits are selectably sized to prevent substantial passage of fill particles into said perforated conduits.

5. Apparatus as defined in claim 1, 2 or 3, wherein said closed conduit is flexible over at least a portion of its length.

6. Apparatus as defined in claim 1, 2 or 3, wherein said closed conduit is connected across adjacent ends of each of said perforated conduits and further comprising, at the opposite end of at least one of said perforated conduits, anchoring means for anchoring said opposite end at the site of said underwater fill.

7. Apparatus as defined in claim 1, 2 or 3, wherein said closed conduit is connected across adjacent ends of each of said perforated conduits and further comprising, at the opposite end of at least one of said perforated conduits:

(a) anchoring means for anchoring said opposite end at the site of said underwater fill; and, (b) shearable connecting means for connecting said anchoring means to said opposite end;

whereby said perforated conduits may be withdrawn from fill surrounding said perforated conduits by imposing a withdrawal force on said perforated conduits sufficient to shear said connecting means.

8. Apparatus as defined in claim 1, 2 or 3, further comprising remote manipulating means connected to each of said sealing means for remotely moving said sealing means into selected positions.

9. Apparatus as defined in claim 1, 2 or 3, wherein said closed conduit is connected across adjacent ends of each of said perforated conduits and further comprising a base plate connected across the opposite ends of said perforated conduits.

10. A method of relieving water pressure in an underwater particulate fill comprising, during construction of said fill, the steps of:

(a) spacing a plurality of upstanding, perforated conduits along the desired site of sloped sides of said fill and on the underwater base of said site;

(b) interconnecting the uppermost ends of each of said perforated conduits with a closed conduit to facilitate water communication between said perforated conduits and said closed conduit;

(c) connecting a water pumping means to said closed conduit; and, (d) operating said pumping means as fresh fill accumulates around said perforated conduits, thereby withdrawing water from fill surrounding said perforated conduits for passage through said perforated conduits and through said closed conduit and discharge from said pumping means.

11. A method as defined in claim 10, further comprising, before said operating step, sealing portions of said perforated conduits not covered by fill to prevent water communication through said non-covered portions.

12. A method as defined in claim 10, further comprising sealing portions of said perforated conduits which are not covered with fill to a depth of about one to two meters to prevent water communication through said non-covered portions.

13. A method as defined in claim 12, further comprising, after commencement of said operating step, and as additional fill accumulates around said perforated conduits, gradually unsealing said sealed portions to maintain a depth of about one to two meters of fill covering unsealed portions of said perforated conduits.

14. A method as defined in claim 13, further comprising, after the perforated portions of said perforated conduits have been entirely unsealed, and as additional fill accumulates around said perforated conduits, gradually withdrawing said perforated conduits from said fill, while maintaining a depth of about one to two meters of fill covering said perforated portions.

15. A method as defined in claim 10, 11 or 12 wherein adjacent ones of said perforated conduits are spaced at least 1.5 meters apart.

16. A method as defined in claim 10, 11 or 12 wherein water withdrawn from fill surrounding said perforated conduits is discharged at a point remote from the point at which fresh fill is added to said underwater fill.

17. A method of increasing the packing density of particles accumulated in a water saturated particulate mass, comprising:

withdrawing pore water from within the body of said mass through a plurality of interconnected upstanding perforated conduits extending through said mass while applying a particle-compacting force to said mass as the water is withdrawn.

* * * * *

UNITED STATES PATENT AND TRADEMARK OFFICE

CERTIFICATE OF CORRECTION

PATENT NO. : 4,664,557

DATED : May 12, 1987

INVENTOR(S) : WILLIAM E. HODGE

It is certified that error appears in the above-identified patent and that said Letters Patent is hereby corrected as shown below:

In the Claims:

Claim 3, column 10, line 28 (claims filed 3/18/85, claim 22, page 24, line 31), "1" should be --2--.

Signed and Sealed this

First Day of December, 1987

*Attest:*

DONALD J. QUIGG

*Attesting Officer*

*Commissioner of Patents and Trademarks*